US008113366B2

(12) United States Patent
House et al.

(10) Patent No.: US 8,113,366 B2
(45) Date of Patent: Feb. 14, 2012

(54) CHILD RESISTANT CONTAINER CLOSURE PACKAGE WITH MULTIPLE TWIST AND TURN CONFIGURATION

(75) Inventors: Randall F. House, Phoenix, MD (US); Barry A. Goldberg, Highland Park, IL (US)

(73) Assignee: MazeTech, LLC, Bala Cynwyd, PA (US)

( * ) Notice: Subject to any disclaimer, the term of this patent is extended or adjusted under 35 U.S.C. 154(b) by 812 days.

(21) Appl. No.: 12/012,783

(22) Filed: Feb. 5, 2008

(65) Prior Publication Data

US 2009/0194500 A1 Aug. 6, 2009

Related U.S. Application Data

(63) Continuation-in-part of application No. 11/004,619, filed on Dec. 3, 2004, now abandoned.

(60) Provisional application No. 60/526,794, filed on Dec. 4, 2003.

(51) Int. Cl.

| | |
|---|---|
| ***B65D 50/02*** | (2006.01) |
| ***B65D 55/02*** | (2006.01) |
| ***B65D 41/34*** | (2006.01) |
| ***B65B 7/28*** | (2006.01) |

(52) U.S. Cl. ..... 215/208; 215/43; 215/223; 215/329

(58) Field of Classification Search ..... 215/43, 215/208, 223, 329–331

See application file for complete search history.

(56) References Cited

U.S. PATENT DOCUMENTS

| | | | | |
|---|---|---|---|---|
| 3,422,977 A * | 1/1969 | Shaw | ..... | 215/208 |
| 3,656,647 A * | 4/1972 | Swinn | ..... | 215/208 |
| 4,071,156 A * | 1/1978 | Lowe | ..... | 215/224 |

* cited by examiner

*Primary Examiner* — Robin Hylton

(74) *Attorney, Agent, or Firm* — Law Offices of John A. Parrish

(57) ABSTRACT

A maze type package that includes a cylindrical container member that has a plurality of mazes thereon is disclosed. The package includes a coaxial closure member that employs studs for engaging the mazes and to releasably secure the closure to the container.

9 Claims, 7 Drawing Sheets

CHILD RESISTANT CONTAINER CLOSURE PACKAGE WITH MULTIPLE TWIST AND TURN CONFIGURATION

This application is a continuation-in-part of U.S. patent application 11/004,619 filed Dec. 3, 2004 now abandoned that claims priority to U.S. provisional patent application 60/526,794 filed Dec. 4, 2003.

BACKGROUND OF THE INVENTION

Pill containers, as well as certain types of liquid containers and the like, involve snap-on and threaded closures. Snap-on and threaded closures, which may be put on and off easily on the container, are of great convenience to the user. Snap-on and threaded closures, however, enable children to open such containers easily and to be exposed to potentially harmful contents. Containers which employ snap-on and threaded closures therefore should be resistant to opening by children, especially children under age 5.

A child resistant package must satisfy specific test standards to comply with protocol specified by the U.S. Consumer Product Safety Commission ("CPSC"). These standards are child resistance effectiveness (CRE) and older adult use effectiveness ('OAUE). CRE is the percentage of children in a group that are unable to open the package within a specified time. CRE is measured by asking pairs of children in a specified age group (30% aged 42-44 months, 40% aged 45-48 months, and 30% aged 49-51 months) to open the package in a specified time period both before and after a nonverbal demonstration. Currently, the CPSC requires a CRE of 85 percent before a demonstration and 80 percent after a demonstration. OAUE is the percentage of adults in a group that is able to open and close the package. OAUE is measured by asking individual adults in a specified age group (typically 60-75 years) to open and close a package using instructions supplied with it in a specified time period. Currently, the CPSC requires an OAUE of ninety percent based on pictorial or written instructions.

Maze type packages are known in the art. These types of packages employ mazes formed of intersecting grooves. Two types of motion typically are employed to open such a package: (1) rotation and (2) linear (usually axial) motion. The sequence of steps employed typically includes alternating a rotary motion with an axial motion. Although maze type packages exist in the prior art, a need continues for maze type packages which are both child resistant and easily opened by adults, particularly elderly adults.

BRIEF DESCRIPTION OF THE DRAWINGS

The invention can be more clearly understood by reference to the drawings forming a part of this disclosure wherein like characters indicate like parts throughout the several views.

SUMMARY OF THE INVENTION

The present invention relates to packages such as child resistant packages which provide ease of use by older adults, particularly adults over 60 years of age. The packages are sufficiently child resistant to provide adequate protection of child health yet not so complex as to be uneconomical or excessively inconvenient for adults, particularly elderly adults over 60 years of age. In particular, the present invention relates to child resistant packages which employ a maze of intersecting circumferential and axial grooves.

The packages include a generally cylindrical container member and a coaxial closure member which may be rotated relative to the container member. The container member and the closure member engage to prevent relative axial movement there between except in predetermined positions.

The closure member advantageously may be snap closed onto the container by pushing the closure downwardly on to the container. The package may be easily opened by people who are slightly handicapped or lack total manual dexterity, such as those who are arthritic. Further advantages of the invention will become apparent from a consideration of the drawings and ensuing detailed description.

DETAILED DESCRIPTION OF THE INVENTION

The closure and container components of the package may be made from materials such as glass, metal, plastics such as polyethylene and polypropylene, as well as paper and the like. The container and the closure components need not be made from the same material. The term package refers to the container with the closure.

Figure 1:
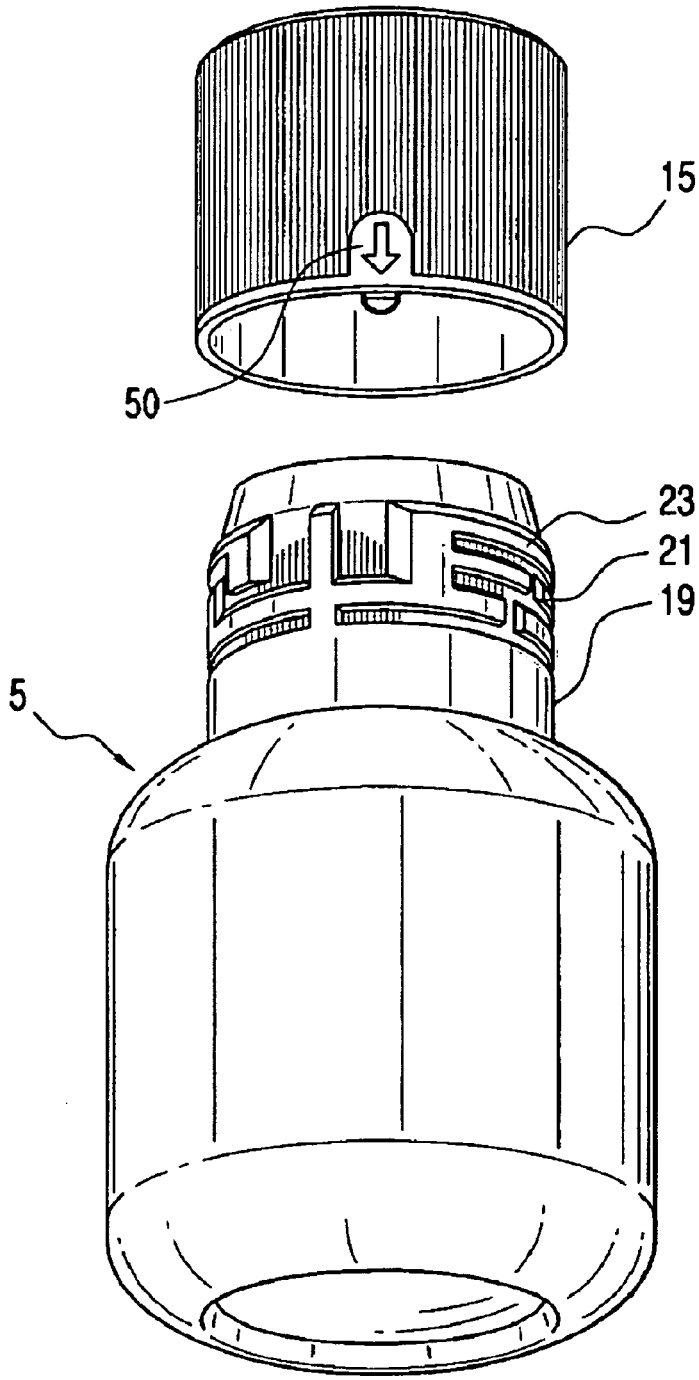
FIG. 1 is an exploded view of a package having a container and a closure.
Figure 2:
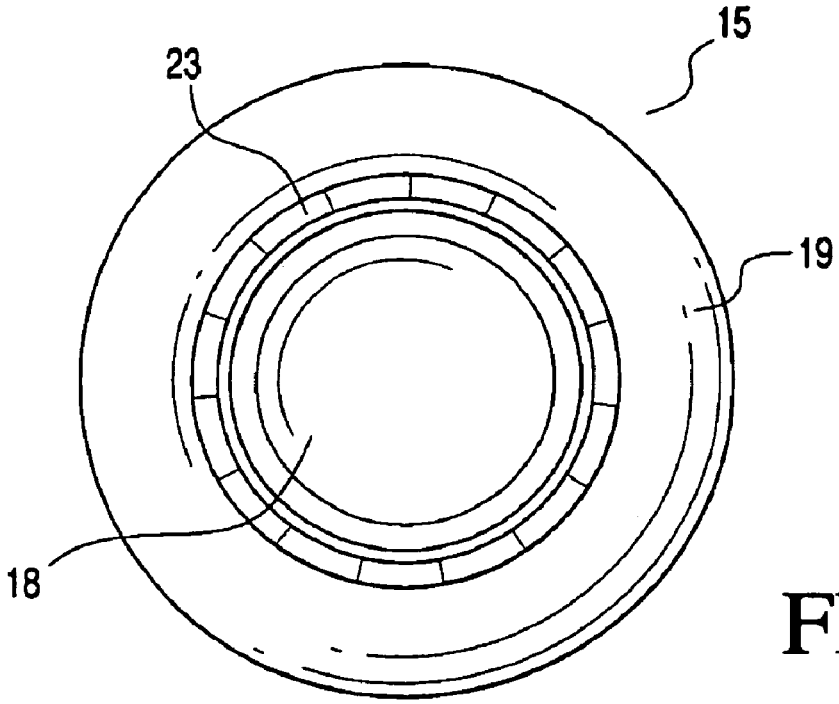
FIG. 2 is a top view of the container of FIG. 1.

Referring to FIGS. 1-8, there is shown an embodiment of package 1 which includes container 5 and closure 15. Container 5 may be of any shape and dimension. Typically, container 5 is a cylindrical receptacle of common diameter throughout its length, or of bottle-like form with neck 17 of reduced diameter. Preferably, and as illustrated in FIGS. 1-8, container 5 includes body 19 and neck 17 joined to body 19. Neck 17 is dimensioned to receive closure 15 thereover. Neck 17 includes opening 18 for permitting access to the contents of container 5. Although neck 17 is shown in FIG. 1 as having a narrower diameter than body 19, the configuration of neck 17 is not so limited.

Figure 4:
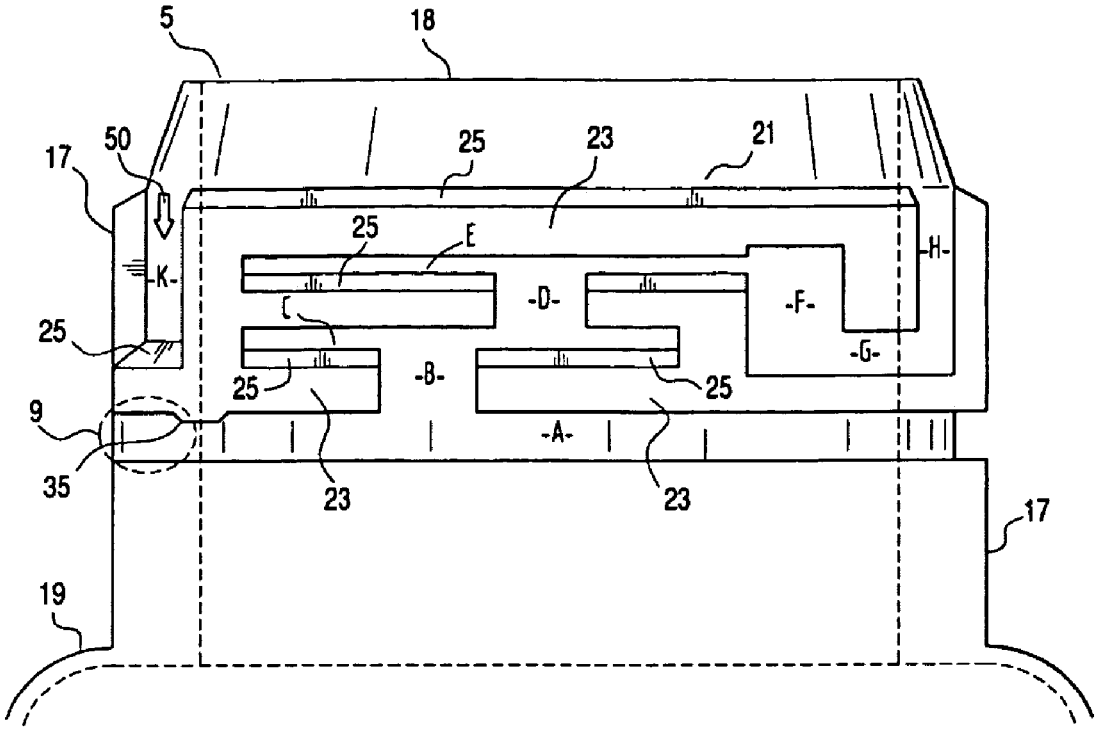
FIG. 4 is a side view of the container of FIG. 1 that shows a configuration of a maze of ribs on the neck of the container of FIG. 1.
Figure 7A:
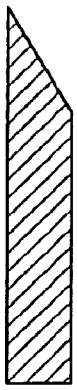
FIGS. 7(*a*)-7(*c*) are cross sectional views of alternative shapes of ribs 23.
Figure 7B:
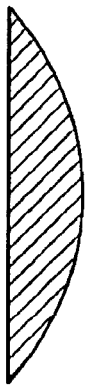
Figure 7C:
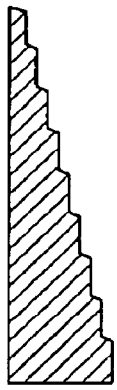
Figure 8:
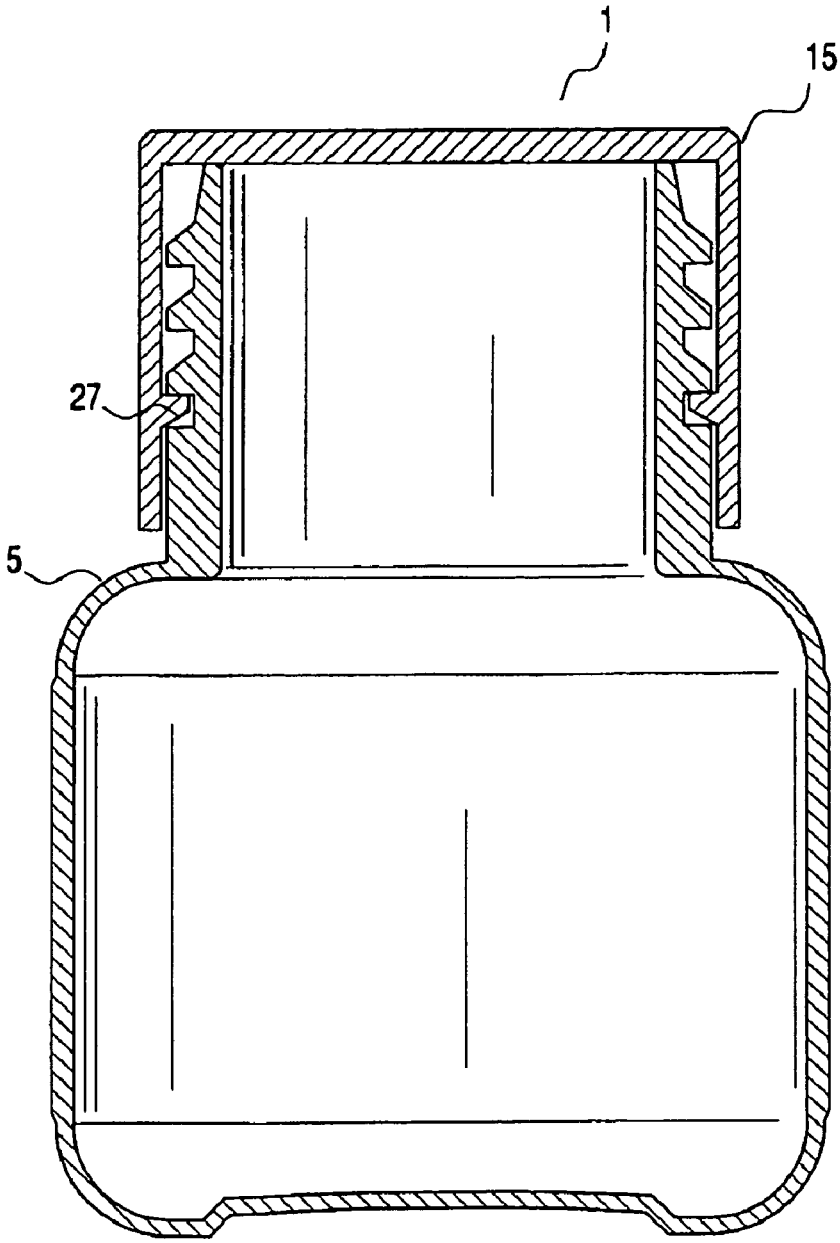
FIG. 8 is a cross sectional assembly view of the package of FIG. 1 that shows the closure attached to the container.

On the outer surface of neck 17 are molded or otherwise provided elevated ribs 23. Ribs 23 form maze 21 of intersecting axial and circumferential grooves (A)-(K) as shown in FIG. 4. Ribs 23 have lower surfaces 24 which are generally flat, preferably within ten degrees of perpendicular to the circumferential surface of neck 17. Ribs 23 may vary in cross-sectional shape. Preferably, ribs 23 have a cross section that is generally trapezoidal as shown in FIG. 7(*a*). Other possible cross sections include but are not limited to hemispherical and stepped as shown in FIGS. 7(*b*) and 7(*c*), respectively. Ribs 23 preferably include downwardly, outwardly tapered portion 25 as shown in FIG. 5A. The angle (β) of tapered portion 25 may vary from about one degree to about 89 degrees, preferably about 30 degrees to about 60 degrees, most preferably about 45 degrees.

In the embodiment shown in FIG. 4, maze 21 includes a number of circumferential and axial grooves (A)-(K) defined by ribs 23. Maze 21 includes lowermost circumferential groove (A), a series of three upper, circumferential grooves (C), (E) and (G), and axial grooves (B), (D), (F), (H) and (K). It is understood, however, that the number of circumferential and axial grooves are not limited to those shown in FIG. 4. Circumferential grooves such as grooves (C), (E) and (G) may be horizontal or angled in a range of about 1 degree to about 20 degrees to the horizontal, preferably about 2 to about 3 degrees to horizontal. Most preferably, the circumferential grooves are horizontal.

In FIG. 4, lowermost groove (A) of maze 21 includes detent 35. Detent 35 functions to secure studs 27 of closure 15 in locking region 9 between detent 35 in groove (A) and inner wall surface 90 of neck 17. Detent 35 most preferably is positioned from inner wall surface 90 of neck 17 by a distance that is about equal to the width of stud 27 so as to enable stud 27 to be secured in locking region 9 without requiring any lateral movement of stud 27 in lowermost groove A. Detent 35, however, may be located a distance of about 11% to about 51% of the length of lowermost groove A distal to surface 90 of neck 17, preferably a distance of about 23% to about 51% of the length of lowermost groove A distal to surface 90 of neck 17, more preferably a distance of about 29% to about 51% of the length of lowermost groove A distal to surface 90 of neck 17. Detent 35 preferably has a trapezoidal cross section as shown in FIG. 4. Detent 35, however, may have a variety of other cross sections such as hemi-spherical, ellipsoidal, square, rectangular and triangular.

Groove (F) may extend above the upper surface of groove (E) as shown in FIG. 4. Groove (F), alternatively, may terminate at the upper surface of groove (E). Groove (C) may extend on each side of the intersection with groove (B). Similarly, groove (E) may extend to each side of the intersection of groove (D). Grooves such as (A), (C) and (E), together with studs 27 described below, limit unintended movement of closure 15. In addition, this minimizes the likelihood that a child can forcibly pry closure 15 off of container 5.

Figure 3A:
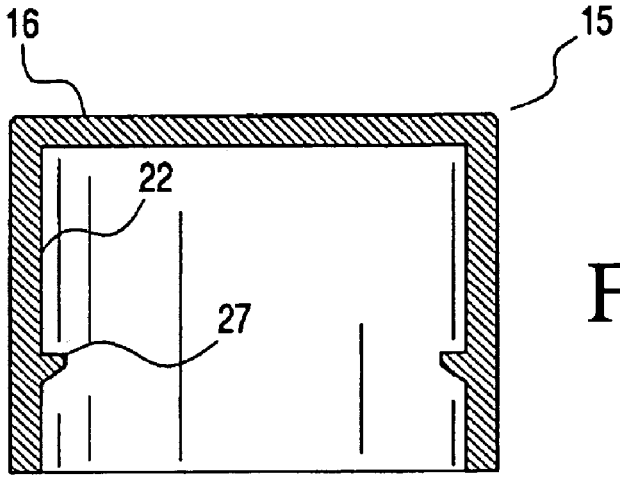
FIG. 3*a* is a cross sectional view of the closure shown in FIG. 1 taken on line A-A.
Figure 3:
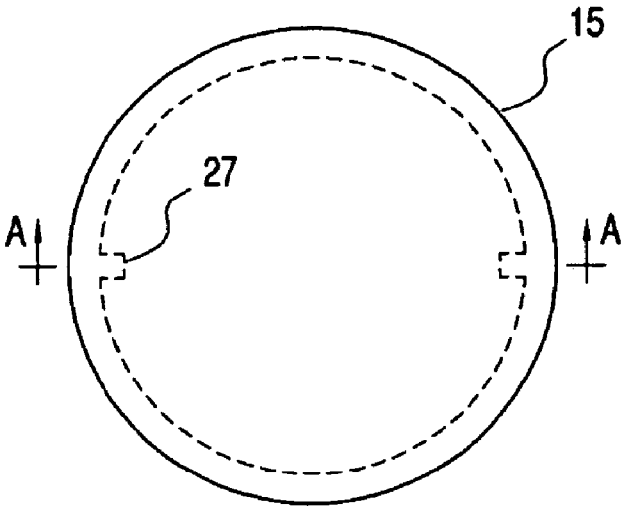
FIG. 3 is a top view of closure 15.

Closure 15 may be of generally conventional design which has a closed top 16 and cylindrical sidewalls 22. Closure 15 has a diameter sufficient to fit over neck 17. In this embodiment, closure 15 is unlined. In other embodiments closure 15 may be lined or linerless (e.g., plug seal). As shown in FIG. 3, two inwardly projecting, diametrically opposed studs 27 are provided on sidewall 22. In this embodiment, there are two diametrically opposed, individual mazes 21, preferably identical mazes 21, each of which extend 180 degrees around the circumference of neck 17. In an alternative embodiment, studs 27 may number four and may be located at ninety degrees to each other. In this embodiment, there are four mazes, preferably identical mazes, each of which extend 90 degrees around the circumference of neck 17. However, this is not so limited and any number of studs may be used, such as, 3, 5, 6 and the like that preferably are equidistant from each other. Preferably, there are an equal number of equally spaced, identical mazes 21 on the container neck 17 as studs 27 on the closure sidewall.

Figure 6:
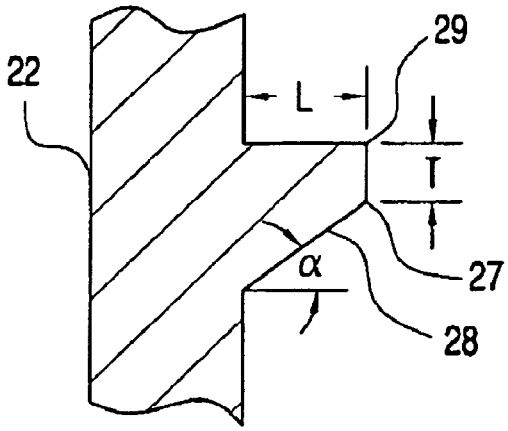
FIG. 6 is a cross section view of an embodiment of stud 27 of closure 15.

Studs 27 preferably have a trapezoidal cross section as shown in FIG. 6. As shown in FIG. 6, stud 27 has an inwardly, downwardly tapered portion 28 and a generally flat, horizontal upper portion 29. Preferably, upper portion 29 is within thirty degrees of perpendicular, most preferably perpendicular to sidewall 22 of closure 15. The tapered portion 28 of stud 27 enables studs 27 to ride over ribs 23 of maze 21 when closure 15 is pushed downwardly onto container 5. This enables a user to easily snap close closure 15 onto container 5 into a secured position in the locking region. Studs 27 have a length L and a thickness T. The length L of stud 27 is sufficient to prevent a child from manually prying closure 15 from container 5. The thickness of stud 27 corresponds to the width of lowermost groove A so as to achieve a snug fit of stud 27 in groove A. The snug fit is sufficient to prevent child from rocking closure 15 off of container 5.

The angle ($\alpha$) of tapered portion 28, as shown in FIG. 6, may vary from about 1 degree to about 89 degrees, preferably about 30 degrees to about 60 degrees, most preferably about 45 degrees.

Figure 5:
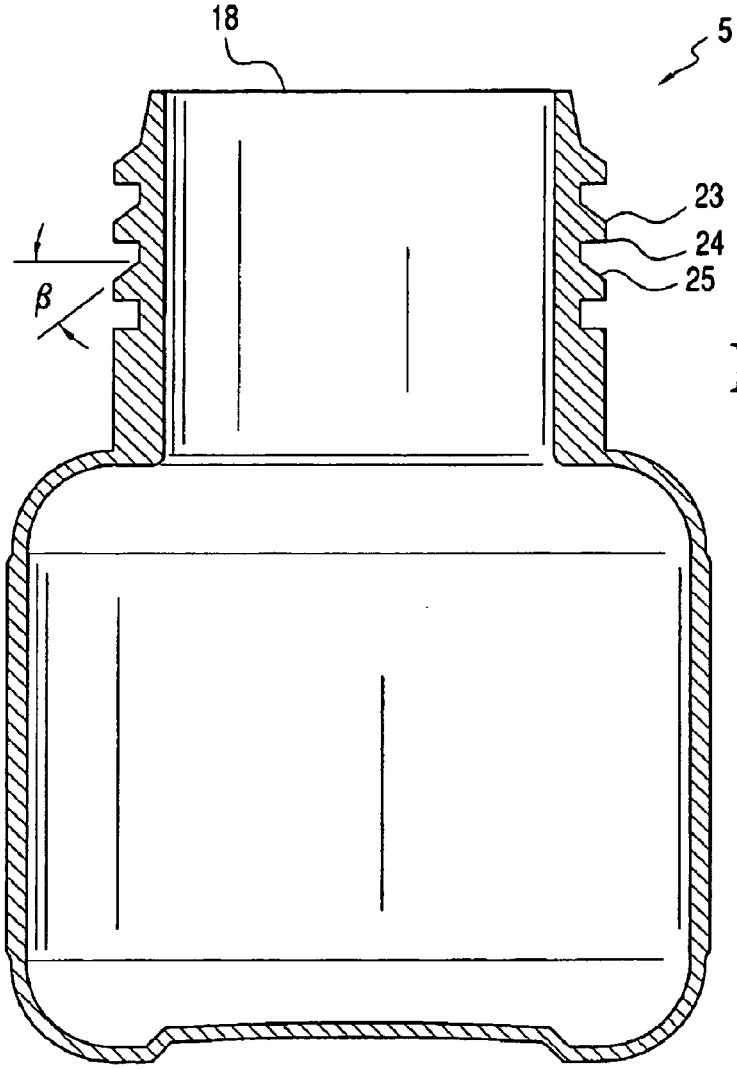
FIG. 5 is a cross sectional view of the container of FIG. 1 showing a rib 23.
Figure 5A:
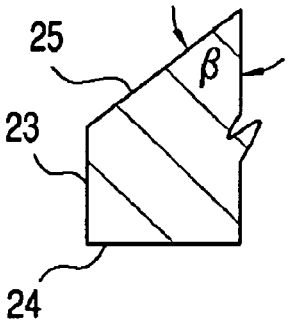
FIG. 5A is an enlarged view of a rib of the maze shown in FIG. 4.

Studs 27 preferably are of a depth and height which correspond approximately with the depth and height, respectively, of lowermost groove (A) of maze 21 as shown in FIGS. 4 and 5. This enables upper surfaces 29 of studs 27 to be in the preferred position of being adjacent and generally parallel to the upper surfaces of a groove of maze 21.

When securing closure 15 onto neck 17 of container 5, closure 15 is first placed onto neck 17 to cause stud 27 of closure 15 to engage axial groove (K) as in FIG. 1. Axial groove (K) may be identified by arrow 50. Downward pressure then is applied to closure 15 to cause stud 27 on closure 15 to ride over ribs 23 to engage the locking region in lowermost groove (A). Lowermost groove (A) includes detent 35 to retain stud 27 in the locking region. Studs 27 and ribs 23 cooperate to enable closure 15 to be snap closed easily onto container 5. This encourages adults who lack dexterity to secure closure 15 onto container 5 to prevent children from gaining access to the contents of container 5.

The child resistant package is opened by rotating and lifting closure 15 relative to container 5. In this way, studs 27 on closure 15 pass through maze 21 to separate closure 15 from container 5. In the embodiment shown in FIG. 8, closure 15 first is rotated counterclockwise to cause stud 27 to ride over detent 35 in lowermost circumferential groove (A) to unlock closure 15. Closure 15 then is rotated counterclockwise to cause stud 27 to engage first axial groove (B). Closure 15 then is lifted to cause stud 27 to engage first upper groove (C). Closure 15 is further rotated counterclockwise in groove (C) to cause stud 27 to engage second axial groove (D). Closure 15 then is lifted to cause stud 27 to engage second upper groove (E). Closure 15 then again is rotated to cause stud 27 to engage third axial groove (F). At this point, closure 15 is lowered to cause stud 27 to engage third upper groove (G). Subsequently, closure 15 is rotated to cause stud 27 to engage fourth axial groove (H). Closure 15 then is lifted to remove closure 15 from container 5. This series of rotary and lifting motions provides the closure of the invention with high child resistance. Moreover, adults with limited manual dexterity may easily open the closure of the invention.

The child resistant package of the invention may be employed in any application where child-resistant benefits are desired to prevent access to the contents of a container. The package therefore may be used for storing of pharmaceutical products, agricultural products, toxic household chemicals, automotive products and other products with certain levels of specific ingredients which are covered within the CPSC guidelines that may be harmful to children. The child-resistant concept also may be used to prevent access to the operating mechanism of devices such as butane lighters, household cleaners, and other devices.

Numerous modifications and variations of the present invention are possible in light of the above teachings. It is therefore understood that within the scope of the appended claims, the invention may be practiced otherwise than as specifically described herein.

The invention claimed is:

1. A maze type package comprising, a cylindrical container (5) having a body section (19) and a plurality of identical, equally spaced mazes (21) on the container (5), and a closure (15) having a plurality of equally spaced, identical studs (27) having a width for engaging the mazes (21) to releasably secure the closure (15) to the container (5), wherein the mazes (21) each comprise a plurality of ribs (23) configured to define a first lowermost circumferential groove (A) having a locking region (9) therein, a second circumferential groove (C) having closed ends, a third circumferential groove (E), a fourth circumferential groove (G), a first axial groove (B), a second axial groove (D), a third axial groove (F), a fourth axial groove (H) and a fifth axial groove (K), wherein the second circumferential groove (C) is disposed above the first lowermost circumferential groove (A), the fourth circumferential groove (G) is disposed above the first lowermost circumferential groove (A) and is circumferentially disposed from the second circumferential groove (C), the third circumferential groove (E) is disposed above each of the first lowermost circumferential groove (A), the second circumferential groove (C) and the fourth circumferential groove (G) and wherein the first axial groove (B) intersects the first lowermost circumferential groove (A) and the second circumferential groove (C), the second axial groove (D) intersects the second circumferential groove (C) and the third circumferential groove (E) and wherein the second axial groove (D) is laterally disposed from the first axial groove (B), and wherein the third axial groove (F) intersects each of the third circumferential groove (E) and the fourth circumferential groove (G) and wherein the third axial groove (F) is circumferentially disposed from each of the first axial groove (B) and the second axial groove (D), and wherein the fourth axial groove (H) intersects the fourth circumferential groove (G) and wherein the fourth axial groove (H) is circumferentially disposed from each of the third axial groove (F), the second axial groove (D) and the first axial groove (B), and wherein the first lowermost circumferential groove (A) includes a detent (35) therein to secure a respective stud (27) in the locking region (9).

2. The package of claim 1 wherein container (5) includes a neck section (17) having a diameter that is smaller than the diameter of the body section (19).

3. The package of claim 2 wherein the mazes (21) are located on the neck section (17).

4. The package of claim 1 wherein the second circumferential groove (C) is horizontal, the third circumferential groove (E) is horizontal, and the fourth circumferential groove (G) is horizontal.

5. The package of claim 1 wherein the detent (35) has a trapezoidal cross section.

6. The package of claim 1 wherein the ribs (23) have a trapezoidal cross section.

7. The package of claim 6 wherein the ribs (23) further include a downwardly outwardly tapered portion (25) wherein the downwardly outwardly tapered portion (25) has an angle of taper ($\beta$) of about one degree to about 89 degrees to horizontal.

8. The package of claim 1 wherein the studs (27) have a trapezoidal cross section including an inwardly, downwardly tapered portion (28) having an angle ($\alpha$) of taper of about 1 degree to about 89 degrees to horizontal.

9. The package of claim 1 wherein the studs (27) have a trapezoidal cross section having an inwardly, downwardly tapered portion (28) wherein the tapered portion (28) that has an angle ($\alpha$) of taper of about 30 degrees to about 60 degrees to horizontal.

* * * * *